US005222602A

United States Patent [19]

Liao

[11] Patent Number: 5,222,602

[45] Date of Patent: Jun. 29, 1993

[54] PACKING CONSTRUCTION

[76] Inventor: Nan W. Liao, No. 18, Zee Yor Road, Hsinchu, Taiwan

[21] Appl. No.: 904,150

[22] Filed: Jun. 25, 1992

[51] Int. Cl.[5] ..... B65D 85/42; B65D 21/02

[52] U.S. Cl. ..... 206/420; 206/504; 206/495; 211/26

[58] Field of Search ..... 206/477, 480, 419, 420, 206/421, 422, 504, 509, 495; 211/26, 13, 60.1, 89; 362/249

[56] References Cited

U.S. PATENT DOCUMENTS

| | | | |
|---|---|---|---|
| 4,228,896 | 10/1980 | Wu | 206/480 X |
| 4,769,749 | 9/1988 | Felski | 211/26 X |
| 4,971,200 | 11/1990 | Huang et al. | 206/420 |
| 5,033,619 | 7/1991 | Garis | 206/419 |
| 5,064,067 | 11/1991 | McAllister et al. | 206/420 |
| 5,123,534 | 6/1992 | Chwang | 206/480 X |

*Primary Examiner*—Steven N. Meyers

*Assistant Examiner*—Jacob K. Ackun, Jr.

*Attorney, Agent, or Firm*—Morton J. Rosenberg; David I. Klein

[57] ABSTRACT

An improved packing construction for a series of light bulbs, mainly comprising packing frames capable of accommodating long series of light bulbs on the side ends of which frames are provided crossly symmetrical male and female dovetail slots and some equidistantly separated trapezoidal tabs among which are seated the bases of long series of light bulbs. This construction further comprises connecting members which lock the bases of two adjacent light bulbs individually mounting on two mutually stacked packing frames to prevent bulbs from clash and keep the two stacked packing frames firm. When an exhibition is desired, the stacked frames can be converted into a plane frame assembly by means of the engagement of the male and the female dovetail slots of a packing frame with those of the other. It indeed is a practical useful packing construction.

1 Claim, 10 Drawing Sheets

PACKING CONSTRUCTION

BACKGROUND OF THE INVENTION

1. Field of the Invention

This invention relates to an improved packing construction for a series of light bulbs. In particular this invention pertains to a packing frame construction having top and bottom wall members on which are formed a plurality of displaced trapezoidally contoured tabs between which are seated a series of light bulbs. The packing frames include sidewalls on which are formed symmetrically positioned male dovetail members and female dovetail slots matingly engageable with respective dovetail members and slots of another packing frame to form a secure planar exhibition frame when the mounted light bulbs are to be exhibited. Still further, this invention relates to packing frames where the wires of light bulbs may be wound thereon in an orderly fashion. Additionally, connecting members may be used to hold two adjacent bulbs mounted on mutually stacked packing frames to prevent hitting of the light bulbs on the walls of the packing boxes. Further, the connecting members provide a construction stability between coupled packing frames.

2. Prior Art

Conventional or prior art packing means for a series of Christmas light bulbs generally fold the series of light bulbs and simply place such in a box. Therefore, the wires of the light bulbs are often tangled during transport and storage or use and the wires are difficult to unwind. Additionally, Christmas type light bulbs are fragile and are vulnerable to impact. Still further, the size of packing boxes depends on the quantity of light bulbs being packed. When light bulbs have an extended length, large packing boxes are needed to accommodate the extended length light bulbs. Large overweight light bulbs may also result in inconvenience associated with packing.

SUMMARY OF THE INVENTION

In view of the previously described disadvantages of the prior art, the present invention concept provides a packing frame suitable for accommodating a series of light bulbs with auxiliary connecting members locking or firmly gripping two adjacent bulbs each mounted between two mutually stacked packing frames to remove the danger of bulb damage and constrain the stacked packing frames. A further object of the present invention is to provide a packing construction in which two packing frames can be connected to form a substantially planar frame assembly by means of the engagement of male dovetail members and female dovetail slots of a packing frame with those of another packing frame so as to provide a construction with the features of firmness and structural integrity as well as the conveniences of permitting exhibition and enhancing packing criteria. Another object of the present invention is that only a single type of packing frame is needed so that the cost of manufacturing and assembling may be minimized. It is still another object of the present invention that the packing frames of the subject invention concept may be added each to the other depending on the quantity of light bulbs. Additional features, objects and detailed construction will become apparent when the description is detailed with reference to the accompanying drawings.

DESCRIPTION OF THE PREFERRED EMBODIMENTS

Figure 1:
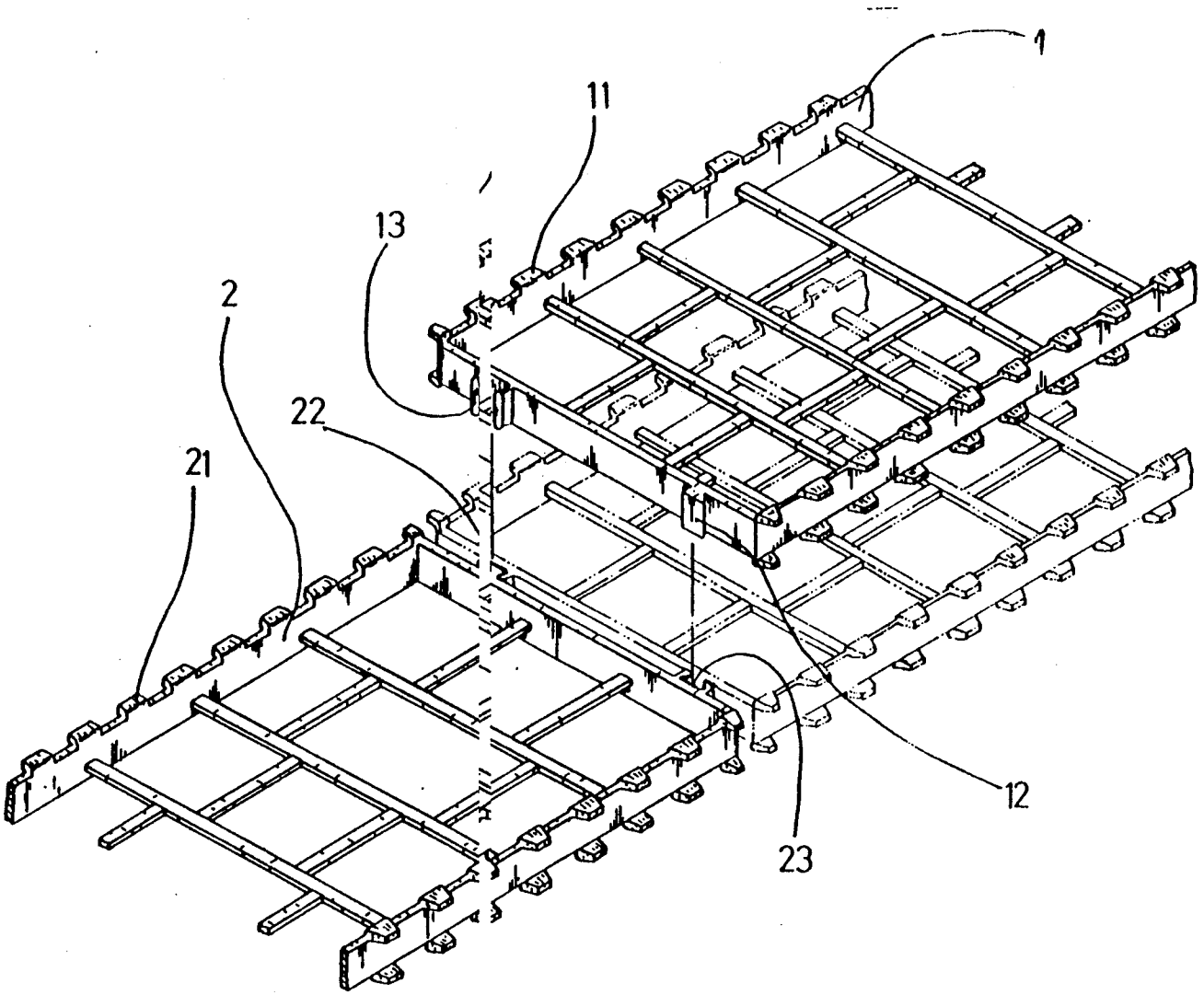
FIG. 1 is a perspective view illustrating the assembly of two packing frames for the purpose of exhibiting light bulbs according to this invention.
Figure 2:
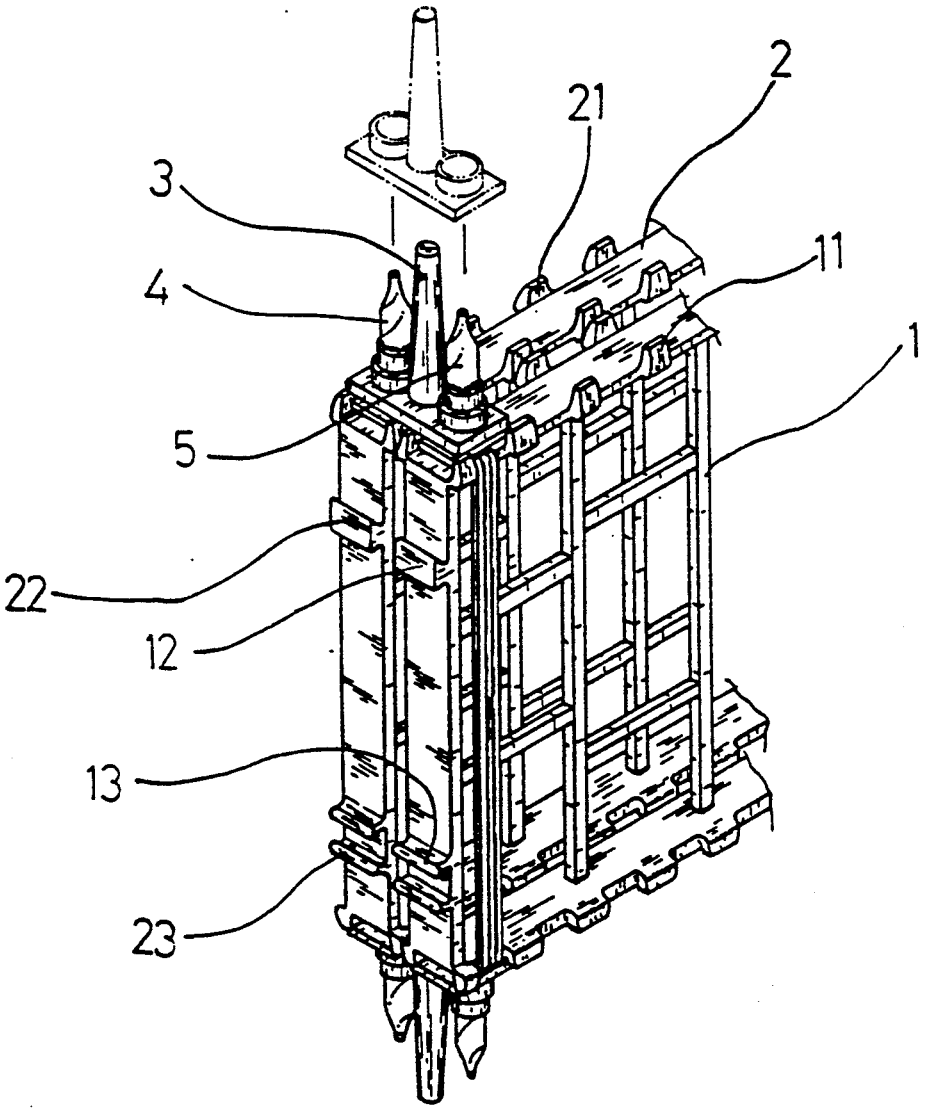
FIG. 2 is a perspective, partially cut away view of the invention concept illustrating the packing frames of FIG. 1 assembled for the purpose of storage and transport.
Figure 3:
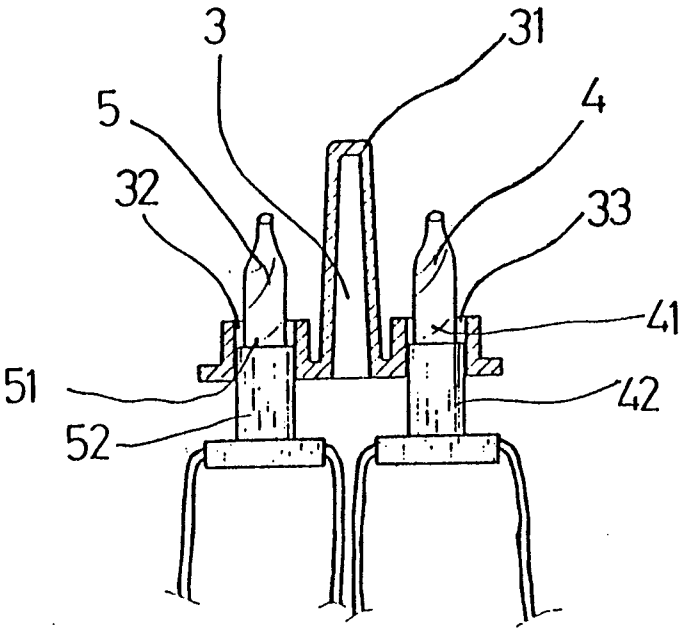
FIG. 3 is a sectional view of the invention concept indicating the manner of mounting a connecting member on two light bulbs.
Figure 4:
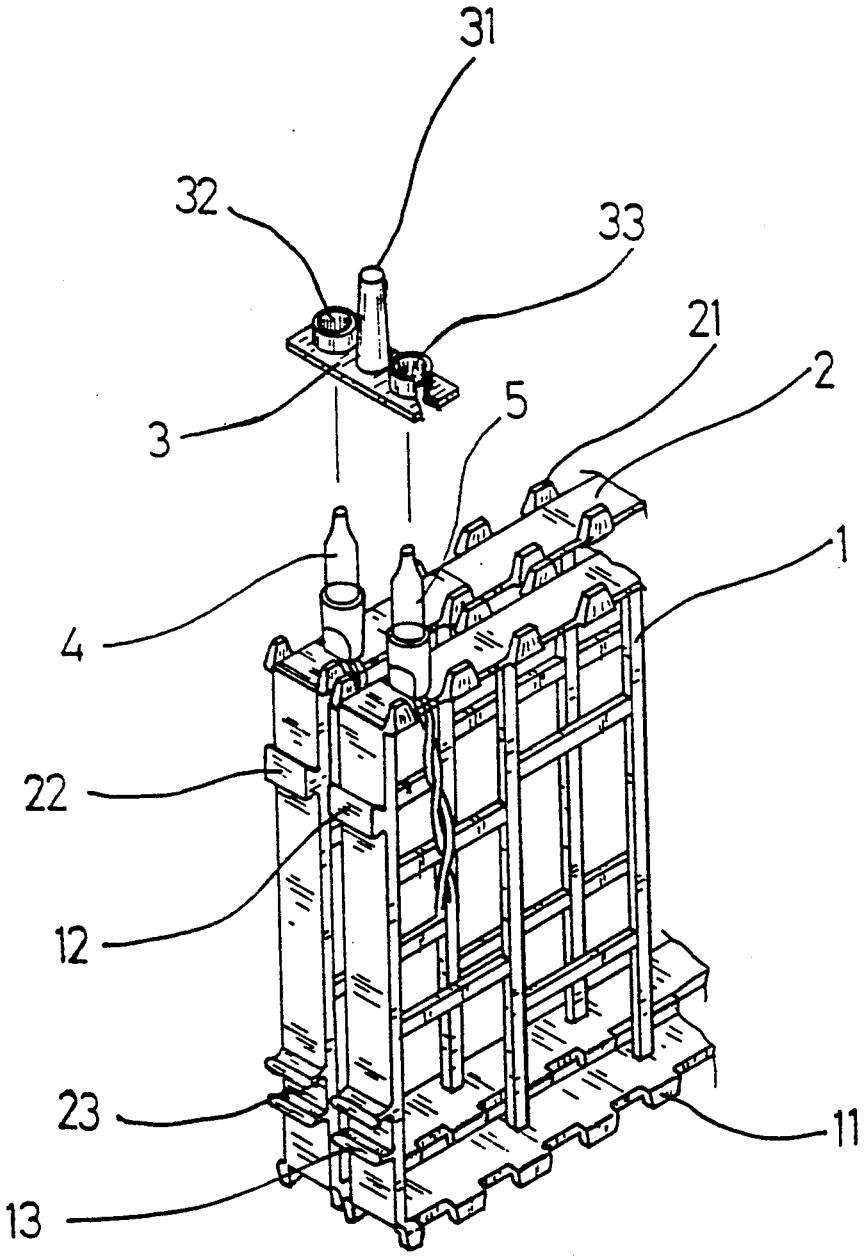
FIG. 4 is a perspective, partially exploded view illustrating a packing concept of this invention.

Referring now to FIGS. 1–4, there is shown packing frames 1, 2 for accommodating and protecting a plurality of light bulbs 4, 5 being packed. As seen in FIGS. 2 and 4, each of frames 1, 2 include a pair of sidewall members and a top and bottom wall member. Each of the top and bottom wall members have formed on them a plurality of equidistantly displaced trapezoidally contoured tab members 11, 21. Each sidewall of each frame 1 and 2 has male dovetail members 12, 22 formed thereon and female dovetail slots 13, 23 which are arranged for mating engagement with a next frame 1 or 2.

Light bulbs 4, 5, each having a bulb 41, 51 and a base 42, 52 are positioned in connecting members 3 which includes a connecting base and has holding portions 32, 33 defining a pair of through openings on its ends and a pole member 31 extending upwardly from the base. The holding portions 32, 33 lockingly engage or secure bulbs 4, 5 around the peripheries of the bulb bases 42 as is shown. The pole members 31 extend above the top of the light bulbs 4, 5 to interface with packing box walls and prevent damage of the light bulbs 4 and 5.

When a series of Christmas light bulbs 4, 5 are to be packed, the light bulb electrical cord is wound around the packing frame 1 or 2 in a manner such that the bases 42, 52 of the light bulbs 4, 5 are respectively mounted on the packing frames 1, 2 between the displaced trapezoidally contoured tabs 11, 12. To protect the bulbs 41, 51 of the light bulbs 4, 5 in the packing process, the connecting member 3 is placed with the holding portions 32, 33 fixedly securing respectively the bases 42, 52 of the light bulbs 4, 5. The pole member 31 extends to a distance greater than the bulbs 4, 5 in order that the bulbs 4, 5 do not touch the packing box wall. Thus, only one or two connecting members 3 are needed to keep the two stacked packing frames firm, secured to each other and protect bulbs from damage as is shown in FIG. 2. As packed light bulbs 4, 5 arrive at their destination, if they are to be exhibited, the two vertically stacked packing frames 1, 2 can be unpacked and assembled by inserting and matingly engaging the male dovetail members 12 and the female dovetail slots 13 of one packing frame 1 into the female dovetail slot 23 and the male dovetail member 22 of the other frame 2 as is shown in FIG. 1.

Figure 5:
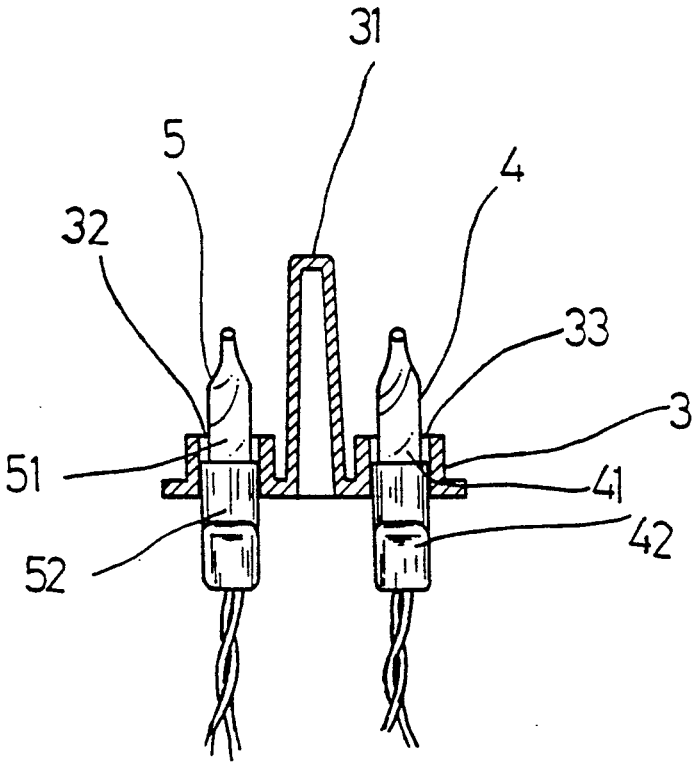
FIG. 5 is a sectional view, partially cut away of the connecting member shown in FIG. 4.

FIGS. 4 and 5 illustrate the application of this invention concept to accommodate another type of light bulb. Depending on the quantity of light bulbs, packing frames can be added and additional connecting members can be installed to obtain a firm, protective construction.

Figure 6:
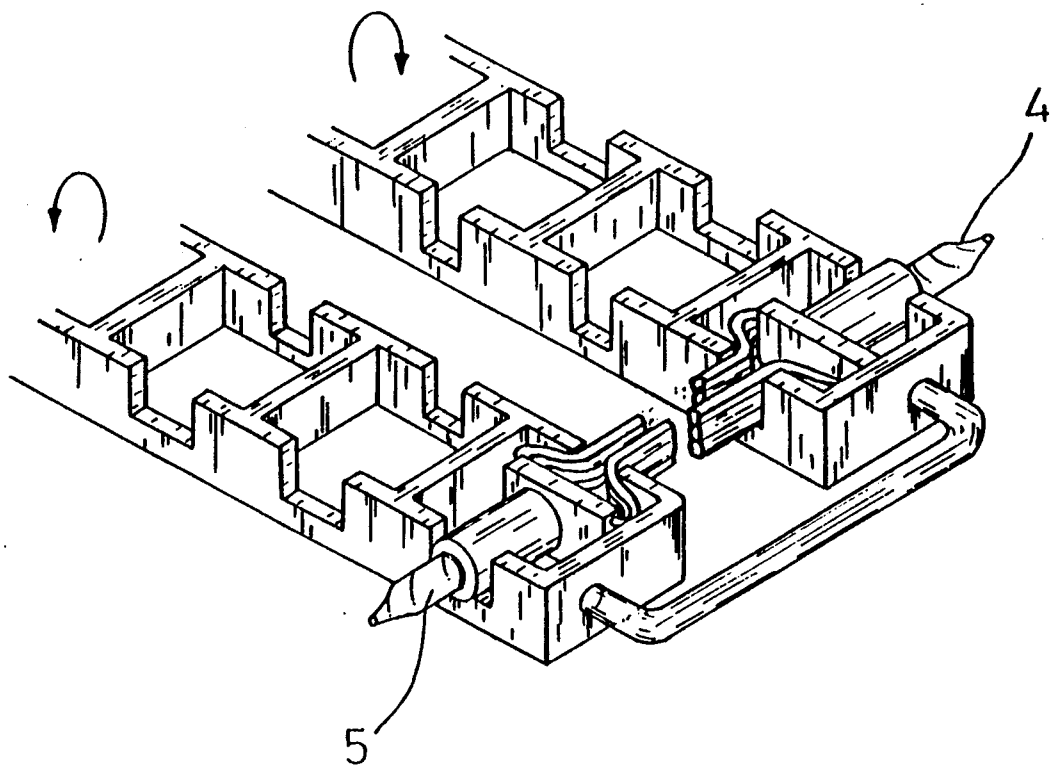
FIG. 6 is a perspective view showing a further embodiment illustrating packing frames of this invention.
Figure 7:
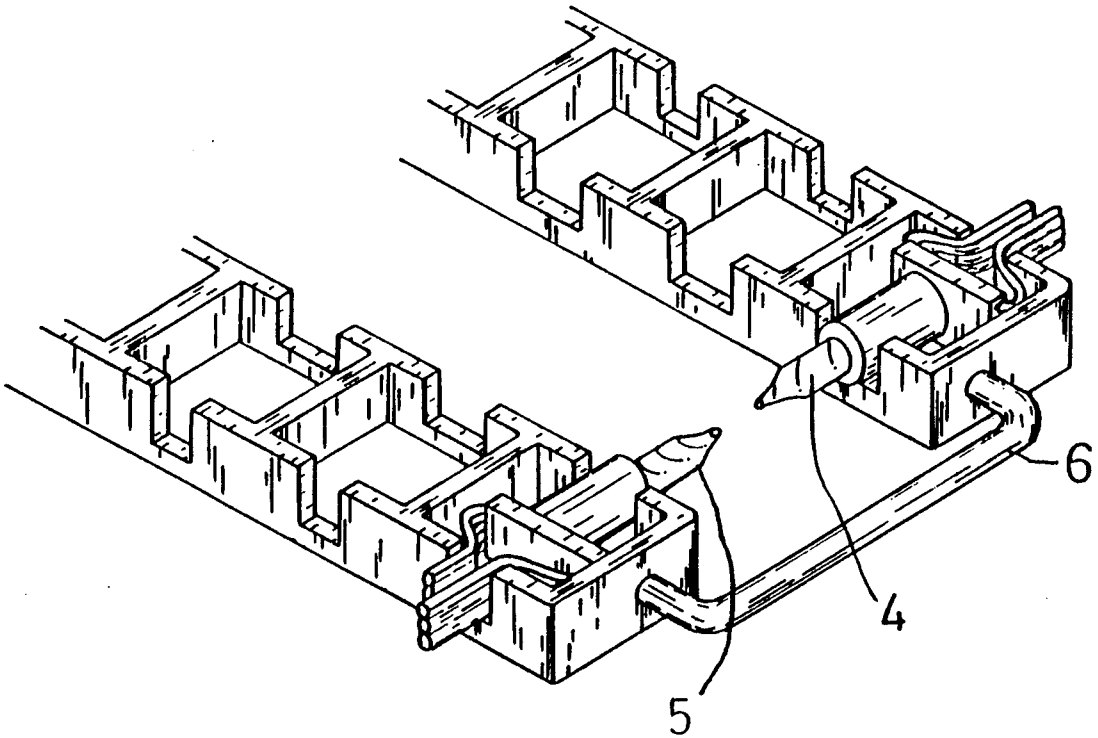
FIG. 7 is a perspective view of packing frames where light bulbs are arranged in a face-to-face manner.
Figure 8:
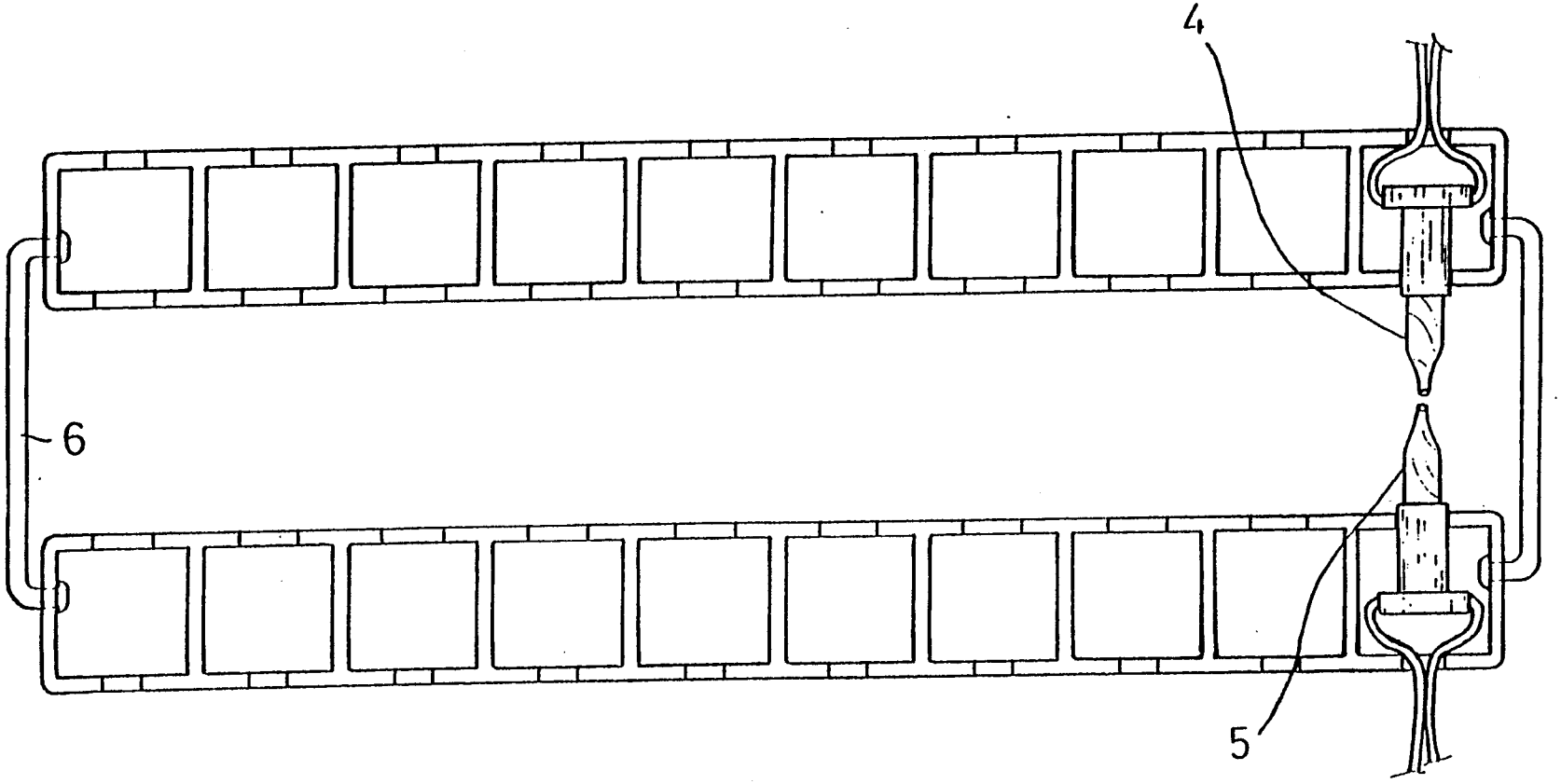
FIG. 8 is a plan view of the embodiment shown in FIG. 7.
Figure 9:
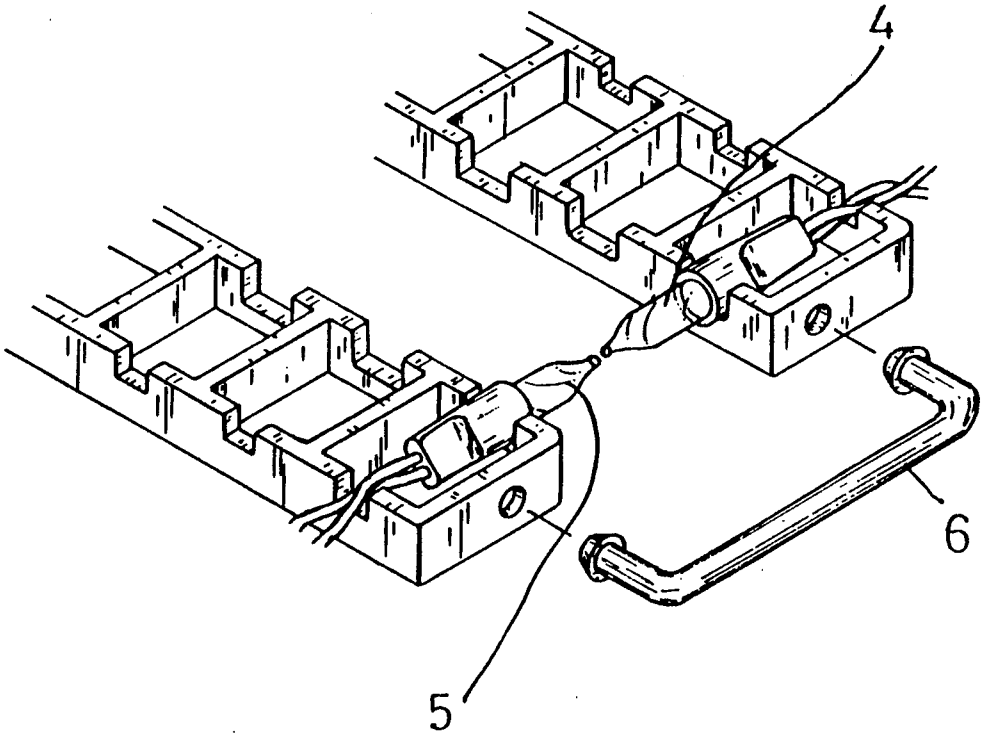
FIG. 9 is a perspective view showing a further embodiment of the invention concept; and, FIG. 10 is a plan view of the embodiment shown in FIG. 9.
Figure 10:
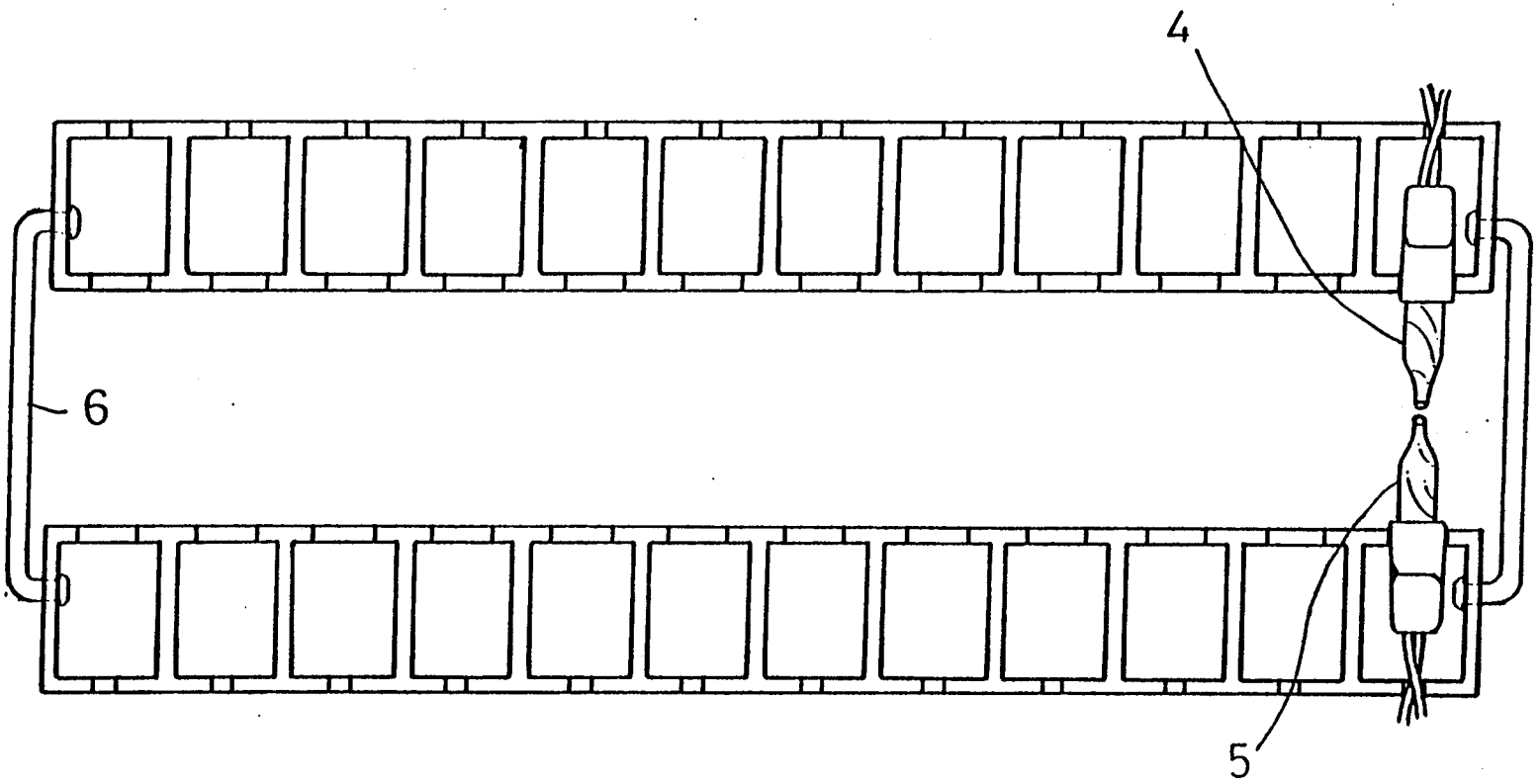

FIGS. 6 and 7 indicate another practical example of this invention concept which employs a U-shaped link rod to connect two single-row packing frames forming a parallel connected assembly in order to increase the capacity of light bulbs. This system provides a similar effect using different holding member contours. Furthermore, the bulbs 4, 5 may be either inwardly directed as shown in FIGS. 7 and 8 or outwardly directed as shown in FIG. 6. FIGS. 9 and 10 show another practical example for packing other types of light bulbs.

As described above, this invention proposes a preferred packing construction for a series of light bulbs where the sides and the ends of packing frames are respectively provided with alignable and matingly engageable male dovetail members and female dovetail slots with equidistantly separated trapezoidally contoured tabs formed on top and bottom wall members. Additionally, an auxiliary connecting member is used to protect the bulbs. With this arrangement, the present invention provides a useful packing frame having a wide scope of applicability which has the advantages of facilitating the packing operation and exhibition of the bulbs. This further provides firm packing frame assemblies with secured light bulbs, preventing light bulb damage from jostling of the bulbs in a container as well as allowing construction of additional packing frames depending on the quantity of light bulbs required.

What is claimed is:

1. A packing system for packing light bulbs having a base portion and a bulb portion comprising:

(a) at least two packing frames, each of said packing frames having a pair of sidewall members and a top and bottom wall member, each of said sidewall members having a male dovetail member and a female dovetail slot formed and positioned thereon for mating engagement of one of said packing frames with the other of said packing frames, each of said top and bottom wall members having a plurality of equidistantly displaced trapezoidally contoured tab members extending therefrom; and (b) at least one connecting member having a connecting member base mounted between a pair of said equidistantly displaced and trapezoidally contoured tab members, said connecting member having a pair of through openings formed through said connecting member base for receipt therethrough of a pair of said light bulbs when said light bulbs are mounted on said frames between said tab members, said connecting member base having a pole member formed between said through openings extending a distance above said connecting member base greater than an extension dimension of said light bulbs above said connecting member base.

* * * * *